US005255791A

United States Patent [19]

Lamort

[11] Patent Number: 5,255,791

[45] Date of Patent: Oct. 26, 1993

[54] END RIM OF CYLINDRICAL SIEVE FOR PAPER PULP STRAINER AND CLASSIFIER AND PROCESS, OF MAKING IT

[75] Inventor: Jean-Pierre Lamort, Vitry le Francois, France

[73] Assignee: E&M Lamort, Vitry le Francois, France

[21] Appl. No.: 876,928

[22] Filed: May 1, 1992

[30] Foreign Application Priority Data

May 3, 1991 [FR] France ..... 91 05453

[51] Int. Cl.[5] ..... B07B 1/49

[52] U.S. Cl. ..... 209/406; 209/273; 29/163.7; 29/163.8; 210/497.1

[58] Field of Search ..... 209/270, 273, 300, 303, 209/305, 288, 400, 405, 406; 29/163.7, 163.8; 210/497.01, 497.1

[56] References Cited

U.S. PATENT DOCUMENTS

| | | | |
|---|---|---|---|
| 2,300,382 | 10/1942 | Hardy | 29/163.7 |
| 2,732,949 | 1/1956 | Ziegenbusch . | |
| 3,101,526 | 8/1963 | Paullus et al. | 29/163.7 |
| 5,053,129 | 10/1991 | Kitson | 210/497.01 |
| 5,128,028 | 7/1992 | LaMort . | |
| 5,143,575 | 9/1992 | Glassel et al. | 210/497.1 |

*Primary Examiner*—Joseph E. Valenza
*Attorney, Agent, or Firm*—Darby & Darby

[57] ABSTRACT

Process of making and mounting an end rim of a cylindrical sieve (1) for paper pulp strainer and classifier characterized by the fact that the rim is of one piece, molded directly on the end of the cylinder with a hardenable or thermosetting plastic material.

5 Claims, 2 Drawing Sheets

END RIM OF CYLINDRICAL SIEVE FOR PAPER PULP STRAINER AND CLASSIFIER AND PROCESS, OF MAKING IT

BACKGROUND OF THE INVENTION

It is known that paper pulp made by recycling used paper must undergo numerous filtering, straining and separating operations. These are generally in strainers and classifiers having cylindrical sieves made of sheet-metal of stainless steel and whose perforations are holes or slots.

The quality of the filtration depends to a large extent on the fineness of the slots (of some tenths of a millimeter) and on the control of this calibration.

According to a classic technique the perforations made by milling in a thick sheet but the cost is high.

In order to lower this cost sieves are made by juxtaposition of U-shaped elements. The perforations are made in a sheet of thin thickness, and are then easier and faster to make.

The U-shaped elements are either flat forming a closed rim and are stacked on one another, or wound spirally. Thus a sieve is obtained by winding on itself a single element of U-shaped profile, as is described in EP 89.402.248.2.

However, with sieves thus made difficulties are encountered in assembling the sieve on the end rims which will center it and maintain it in the apparatus.

In fact, when the sieve is made by winding of a U-shaped section, the ends of the sieve do not present a plane perpendicular to the axis of the sieve on which the rim can easily abut and be welded or screwed.

And when the sieve is made by spiral winding of flat stock on edge, on a thin perforated sheetmetal, this helicoidal flat stock does not facilitate the mounting of an end rim which must remain perpendicular to the axis of the cylinder.

OBJECTIVE OF THE INVENTION

The objective of the invention is to resolve these difficulties of installing a steel rim and its object is a process of making and mounting end rims of a cylindrical sieve for paper pulp strainer and classifier.

BRIEF DESCRIPTION OF THE INVENTION

It is characterized by the fact that the rim is made in a single piece molded directly on the end of the cylinder with a hardenable or thermosetting material.

This process is further characterized in that:

the mold is a circular hollow rim whose cross-section has the form of the known rims, of a depth equal to at least one width of a U-shaped element.

the mold has closable openings for the positioning of implants provided for the mounting of the cylinder in the mold and/or in the strainer or classifier, or the extraction of the sieve out of the strainer (inserts for the extraction of the strainer, insert for rotational blocking of the rim and of the sieve, etc . . . );

the mold has means of relative positioning and wedging of the cylinder;

when the material is cooled and hardened, the cylinder is extracted from the mold and turned over and the same operations are carried out for the other end.

The invention further relates to cylindrical sieves for paper pulp strainers and classifiers characterized in that they are equipped at their ends with a one-piece rim of thermosetting plastic material.

BRIEF DESCRIPTION OF THE DRAWINGS

The invention will be better understood by the description of an example of realization illustrated in the annexed drawing in which.

DETAILED DESCRIPTION OF THE DRAWINGS

Figure 1:
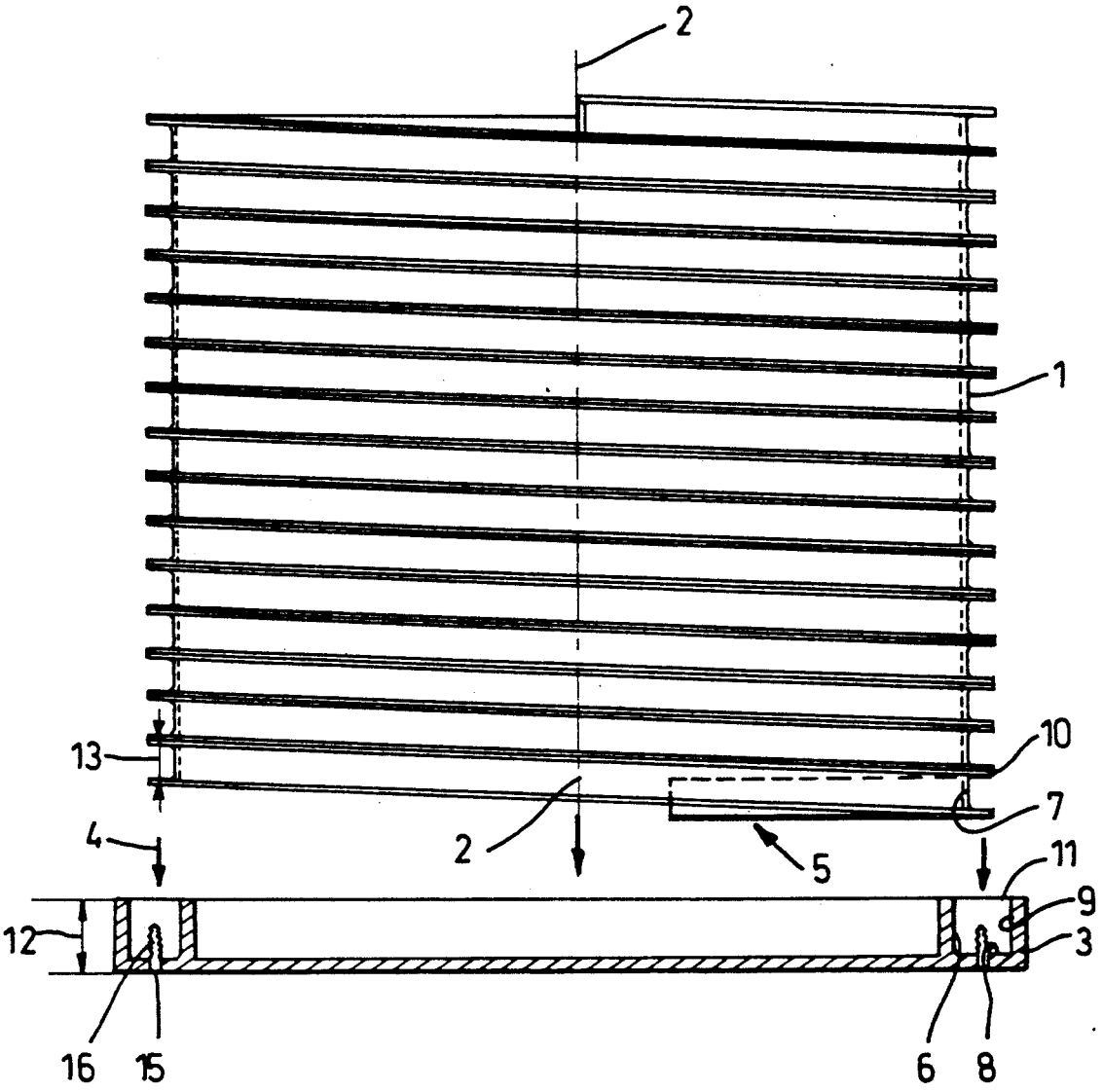
FIG. 1 represents a side view of a sieve on top of a mold.
Figure 2:
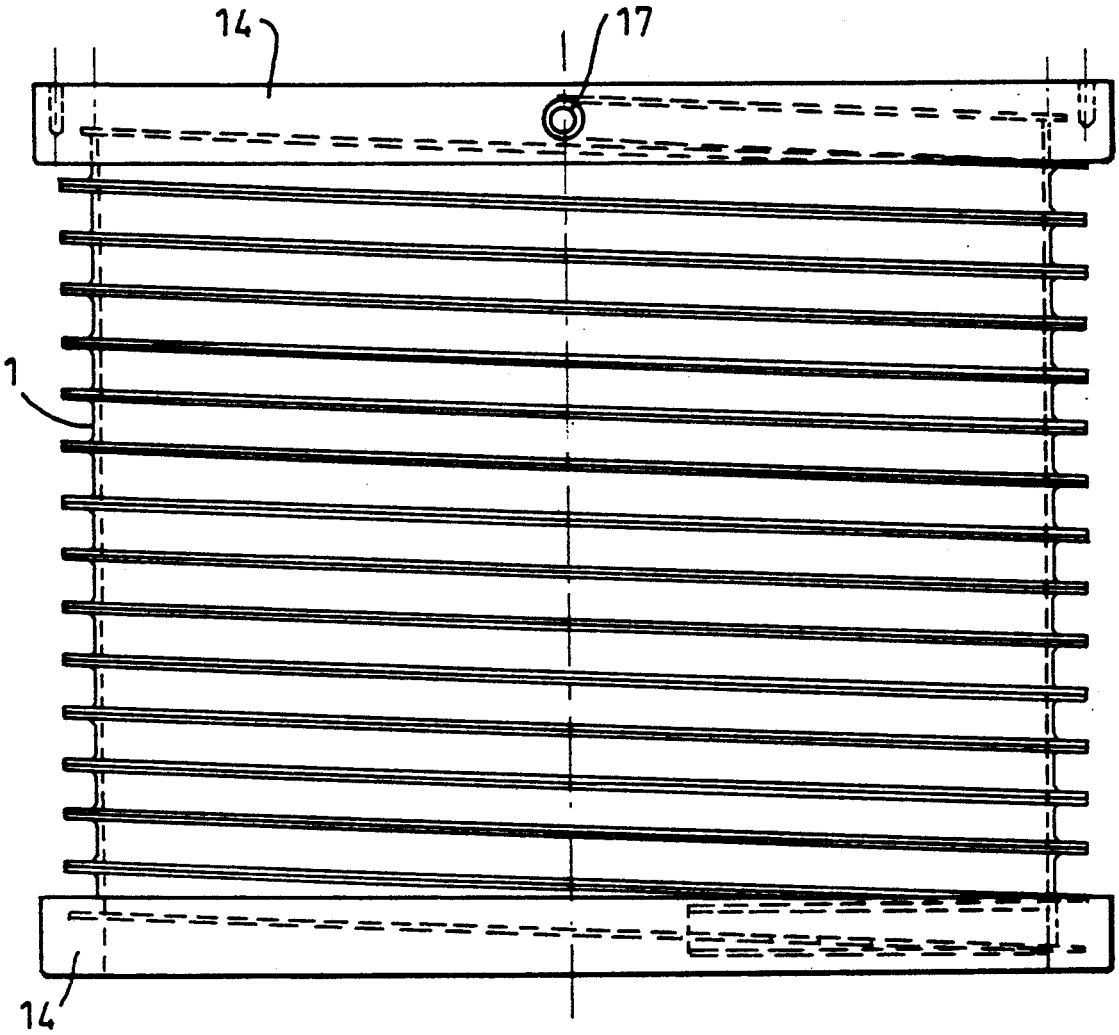
FIG. 2 represents a side view of the same sieve equipped with its rims, after removal from the mold.

The sieve 1 of the figure is a spiral sieve made by winding a U-shaped section, to give a cylinder according to patent EP 89.402.248.2.

The ends of this cylinder do not each form a single plane.

The end piece or rim 14 which must form a plane perpendicular to the axis 2 of the cylinder is, according to the invention, made in a mold 3 into which dips 4 is inserted, as indicated by the arrow 4, the end 5 of the cylinder.

The mold 3 is a hollow circular rim whose form, in transverse section, is that of the cross-section of the end rims of a common strainer. It presents notably an inner or outer flank 6 against which bears the bottom 7 of the U-shaped profile, a flat bottom 8, and an outer or inner flank 9 on the side of the end 10 of the flanges of the U.

The mold is shown open at the top 11. It may be closed by a cover and in that case the cover has the passage or passages for the flanges of the U-shaped elements.

Its depth 12 is preferably at least equal to the total width 13 of U-shaped element in such a way that a complete circumference of a flange of the element fits into the mold.

This depth can be less notably in the case of the various sieves not having helical elements, and whose end elements are planar and perpendicular to the axis 2 of the cylinder.

Furthermore the mold has at the bottom and laterally closable holes 15, provided for the placing of inserts 16 for making cavities, whether threaded or not, necessary for example either for the installation of the sieve in the strainer or sorter, or for the extraction of the sieve from said strainer or sorter. There also can be an insert 17 for blocking rotation of the sieve.

The mold has cylinder positioning and blocking means. These means are intended to ensure the proper verticality of the cylinder in a perfectly horizontal mold, and to determine a distance between the lower end of the sieve (that is to say the edge of the U-shaped element) and the bottom of the mold in order that the end of the sieve will not touch the outer surface 14 of the rim.

Figure 3:
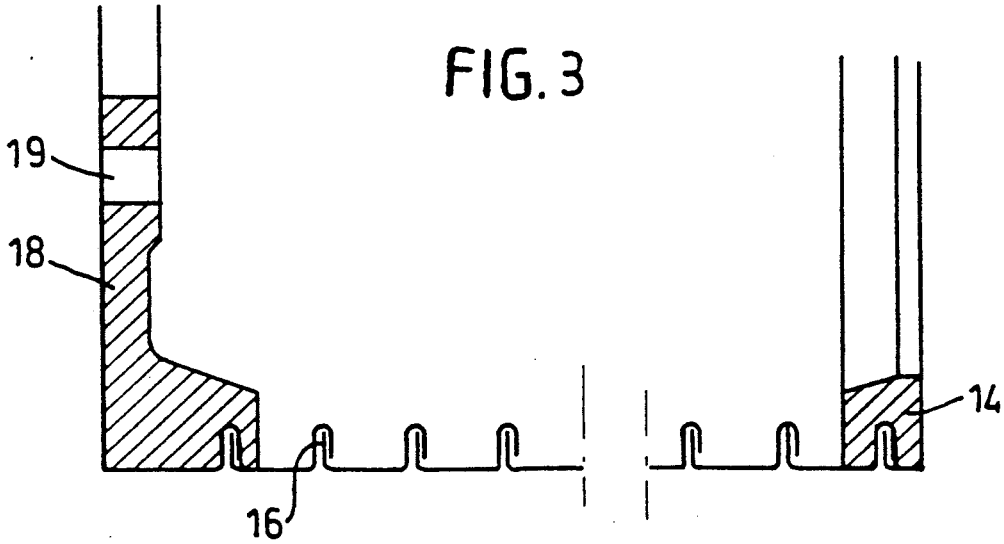
FIG. 3 represents a vertical sectional view of a variant of a molded rim having a positioning extension.

In a variant illustrated in FIG. 3, the mold has at least two vertical extensions 18 which are traversed horizontally by a screw or other fastener to be inserted through hole 19 to bear against the cylinder 1 to lock it in place.

This arrangement is of course not limiting and other variants could be provided while remaining within the frame of the invention (for example the inserts 16, 17 can be used for this purpose).

The mold being installed on a horizontal plane, the sieve cylinder is introduced therein vertically and it is maintained suspended in this position at a predetermined level in the mold (by the positioning and blocking means 18, 19. Then one pours into the mold a thermosetting plastic liquid known in itself whose low-temperature mechanical characteristics are at least comparable to that of stainless steel.

After a minimal setting time one removes from the mold the cylinder 1 equipped with its rim 14, and then one begins the operation over again on the opposite side of the cylinder.

As is seen, the operation is simple and fast to perform. It offers furthermore numerous and considerable advantages:

it permits to adapt oneself to all forms of the cylinder ends;

the plastic, in addition to its properties of mechanical strength, possesses a certain flexibility which permits to better absorb the vibrations and suppressions in the strainer;

the mounting precision in the sieve is constant;

the weight of the sieve is considerably lightened;

the material cost is clearly less;

the process is usable on any type of cylindrical sieve;

the manufacturing time, that is, the finishing of the sieve, is considerably reduced as compared to the customary mounting time to the metal rim it is limited to the hardening time of the material.

the invention is of course not limited to the molding process described and extends to the other known processes, the choice of the process depending generally on the plastic or composite material chosen.

I claim:

1. A cylindrical basket sieve for a strainer or classifier comprising:

a metal element having a channel shaped cross-section forming a hollow cylinder, and a rim of thermosetting plastic material molded onto each end of said cylinder, said rim having a U-shaped peripheral channel into which a respective end of the cylinder fully fits.

2. A cylindrical basket sieve as in claim 1 wherein said channel shaped element is wound in helicoidal form.

3. A cylindrical basket sieve as in claim 2 wherein the cross-section of said element is U-shaped.

4. A cylindrical basket sieve as in claim 3 further comprising means extending through said rim and engaging said cylinder to further fasten said rim to said cylinder.

5. A cylinder basket sieve as in claim 3 further comprising a bracket at an end of the cylinder having one wall engaging said sieve and another wall resting on the bottom of said rim channel to vertically position said cylinder in said rim.

* * * * *